United States Patent [19]

Linde

[11] 4,091,633

[45] May 30, 1978

[54] PROCESS AND APPARATUS FOR THE SEPARATION OF A LOW-BOILING GASEOUS MIXTURE

[75] Inventor: Gerhard Linde, Munich, Germany

[73] Assignee: Linde Aktiengesellschaft, Wiesbaden, Germany

[21] Appl. No.: 712,264

[22] Filed: Aug. 6, 1976

[30] Foreign Application Priority Data

Aug. 8, 1975 Germany ..... 2535489

[51] Int. Cl.[2] ..... F25J 3/04

[52] U.S. Cl. ..... 62/29

[58] Field of Search ..... 62/30, 29, 42

[56] References Cited

U.S. PATENT DOCUMENTS

| | | | |
|---|---|---|---|
| 1,521,115 | 12/1924 | Mewes | 62/30 |
| 1,945,367 | 1/1934 | Gobert | 62/29 |
| 2,002,940 | 5/1935 | Frankl | 62/29 |
| 2,514,921 | 7/1950 | Yendall | 62/29 |
| 2,587,820 | 3/1952 | Cartier | 62/29 |
| 2,711,085 | 6/1955 | Anderson | 62/30 |
| 2,932,174 | 4/1960 | Schilling | 62/29 |
| 3,173,778 | 3/1965 | Gaumer | 62/29 |
| 3,575,007 | 4/1971 | Gunther | 203/26 |

*Primary Examiner*—Hiram H. Bernstein
*Attorney, Agent, or Firm*—Millen & White

[57] ABSTRACT

A process for the separation of a low-boiling gaseous mixture by low-temperature rectification, comprising the steps of:

(a) subjecting said gaseous mixture to rectification in a high pressure zone to obtain a crude light fraction and a crude heavy fraction;

(b) passing said crude light fraction and said crude heavy fraction to an intermediate pressure rectification zone to obtain an enriched gaseous overhead and an enriched liquid bottoms;

(c) passing said liquid bottoms into a low-pressure rectification zone; and (d) withdrawing vapor from said low pressure rectification zone by suction, increasing the pressure of said vapor and passing said vapor into the intermediate pressure rectification zone;

whereby the pressure in the high pressure stage is lower than the pressure in a high pressure stage of a double column employing two pressure stages.

11 Claims, 2 Drawing Figures

PROCESS AND APPARATUS FOR THE SEPARATION OF A LOW-BOILING GASEOUS MIXTURE

BACKGROUND OF THE INVENTION

This invention relates to a process and apparatus for the separation of a low-boiling gaseous mixture by two-stage low-temperature rectification.

In conventional processes of this type, it is in most cases conventional to adjust the pressures in both stages so that the light fraction of the high-pressure stage is condensed in indirect heat exchange contact with the evaporating, heavy fraction of the low-pressure stage. More detailed information can be found in "Chemie-Ingenieur-Technik" [Chemical Engineers' Technology] 46 (1974) : 881–924. The pressure in the low-pressure stage is designed to be just so high that the products withdrawn from the head of this stage can be discharged from the plant against the frictional flow resistance of the pipelines. Especially in low-temperature separation plants having very large throughput quantities wherein the refrigerating losses are minor as compared to the compression energy to be expended, the total energy consumption is determined to a considerable part by the amount of energy necessary to compress the feed gas to the pressure of the high-pressure stage.

SUMMARY OF THE INVENTION

An object of this invention is to provide a system wherein the high-pressure stage can be conducted at a lower pressure, thereby saving significant compression energy.

Upon further study of the specification and appended claims, further objects and advantages of this invention will become apparent to those skilled in the art.

These objects are attained by withdrawing the gas under suction from the lower portion of the low-pressure stage above a partition delimiting the lower portion of the low-pressure stage.

By this measure in accordance with the invention, the pressure is lowered in the lower portion of the low-pressure stage. Consequently, the heavy fraction can evaporate in the sump of the low-pressure stage at a lower temperature (vapor pressure relationship). Since the sump of the low-pressure stage is, as is customary, in heat contact with the head of the high-pressure stage, the light fraction can condense at that point at a lower pressure, due to the lowered temperature. The lower pressure, in turn, results in the desired saving in energy. Due to the fact that, according to the invention, the gas withdrawn under suction from the lower portion of the low-pressure stage is reintroduced above a partition, the pressure relationships still are such that the product gases can leave the plant against the flow resistance in the pipes.

The utilization of the process of this invention is particularly advantageous if the gas is withdrawn under suction from the lower portion of the low-pressure stage by means of an ejector (jet compressor) since in this case a certain excess pressure in the high-pressure stage can be utilized in a very favorable manner for the operation of the ejector.

In a particularly advantageous embodiment of this invention, a crude fraction of the heavy component is utilized for the operation of the ejector, this fraction being formed by fractional condensation in a reflux condenser. To ensure the refrigeration requirement in the reflux condenser, the thus-obtained crude fraction of the heavy component is expanded and vaporized in heat exchange with the mixture fractionally condensing in the reflux condenser.

The pressure after the expansion is selected so that it is above the pressure of the low-pressure stage, and the remaining pressure difference suffices to operate the ejector in the manner according to the present invention. This embodiment leads to a maximum saving in energy in the mode of operation of the process according to the invention.

In another embodiment of this invention, gas is utilized for operating the ejector which is withdrawn in the liquid phase from the lower portion of the high-pressure stage, vaporized in the head of the high-pressure stage after a throttle expansion in a condenser, and conducted to the ejector. The thus-expanded liquid therefore serves to cool the head of the high-pressure stage. The vaporization pressure of this liquid is above the pressure of the low-pressure stage. The remaining excess pressure is utilized for operating the ejector.

Suitable for conducting the process of this invention is a two-stage rectifying column wherein the lower portion of the upper column is separated by a partition (separating baffle) and which has a pipeline leading from the space below the partition via a compressor into the space above the partition.

By virtue of the present invention, there are thus essentially four pressure stages having generally the following pressure ranges in bars

| | General | Preferred |
|---|---|---|
| Bottom of Column below partition (separating baffle) | 1.01–1.3 bar | 1.1 bar |
| Top of Column | 1.01–1.3 bar | 1.1 bar |
| Middle of Column above partition (separating baffle) | 1.25–1.6 bar | 1.35 bar |
| High Pressure Column | 4.5–4.9 bar | 4.6 bar |

DETAILED DESCRIPTION OF DRAWINGS

Figure 1:
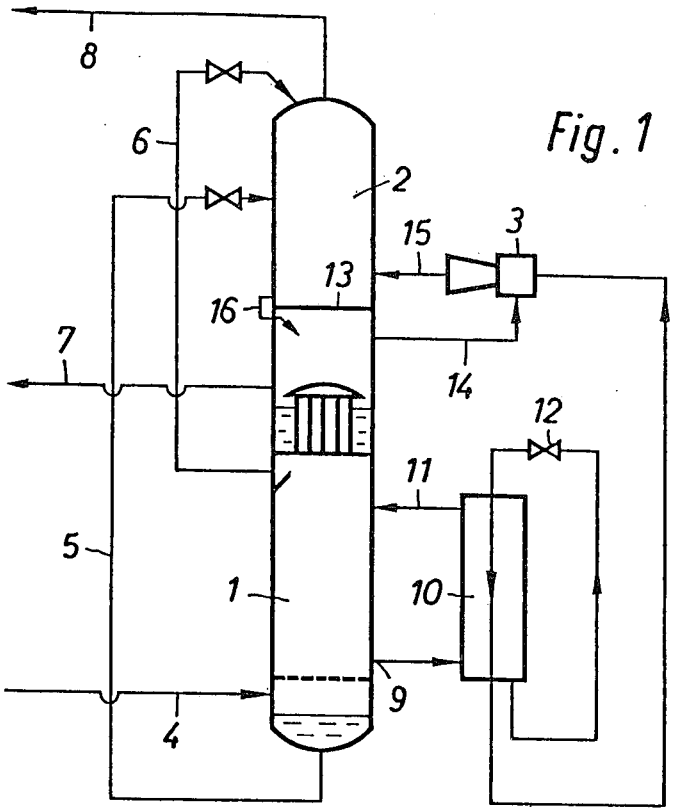
FIG. 1 is a schematic illustration of a preferred air separation plant with a reflux condenser.

Identical parts in the two figures bear the same reference numerals. Only the part of a two-stage air separation plant relevant to the invention is depicted.

Numerals 1 and 2 designate a high-pressure column and a low-pressure column, respectively. An ejector is denoted by numeral 3.

In FIG. 1, the cooled and compressed air enters the high-pressure column 1 at 4 for purposes of rectification. The air, separated into crude oxygen and nitrogen is introduced under throttling into the low-pressure column 2 via conduits 5 and 6. The separation products oxygen and nitrogen are withdrawn from the low-pressure column 2 via conduits 7 and 8.

In accordance with the invention, air is withdrawn from the high-pressure column 1 at 9 and subjected to a fractional condensation in a reflux condenser 10. The nitrogen obtained during the fractional condensation is introduced into the high-pressure column at 11. The liquid crude oxygen collected in the lower portion of the reflux condenser 10 is expanded, for the production of cold, in valve 12 to a pressure of 2.8 bars and conducted countercurrently to the gas ascending in the reflux condenser under heat exchange contact therewith. This stream serves as the driving stream for the ejector 3, the latter taking in gas via conduit 14 from below a partition 13 and reintroduces such gas via conduit 15 above the partition 13 to an intermediate pressure zone. The reflux from the intermediate pressure zone in the low-pressure column is conducted past the partition by way of the compensating conduit 16. The pressure below the partition 13 is lowered to 1.1 bars in a low pressure zone whereas the pressure above the separating baffle 13 is raised to 1.35 bars. This ensures that the separation products withdrawn via conduits 7 and 8, after considering the pressure loss on the plates of the low-pressure column 2, still have a sufficient excess pressure to be able to leave the plant. Thus, a pressure of 1.2 bars is ambient, for example, in the sump of the low-pressure column. From the vapor pressure relationship the result is obtained that the high-pressure column can thus be operated at a pressure of 4.6 bars.

Figure 2:
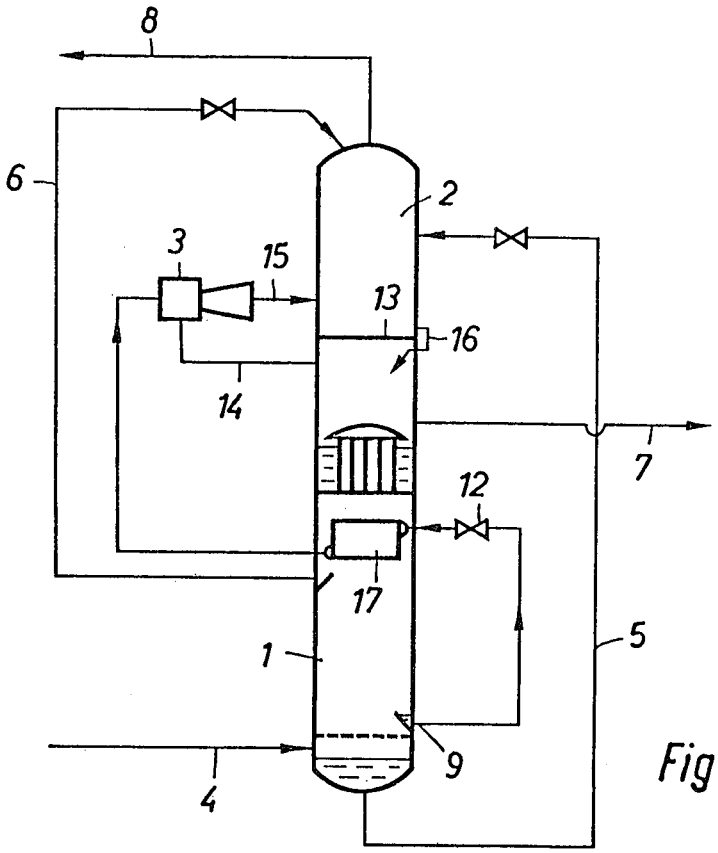
FIG. 2 is a schematic illustration of a preferred air separation plant with a plate-type condenser.

In the process illustrated in FIG. 2, the reflux condenser is eliminated. Instead, the cold of the liquid crude oxygen partially expanded in valve 12 is used in the plate-type heat exchanger 17 for condensing the nitrogen gas rising in the high-pressure column 2. The residual pressure of 2.5 bars remaining after partial expansion and vaporization in valve 12 is utilized for operating the ejector 3. In this mode of operation, the pressure below the partition 13 can be lowered to 1.2 bars and raised to 1.36 bars above the partition. The pressure in the sump of the low-pressure column is adjusted to 1.33 bars, due to the pressure loss on the plates between the partition and the sump. As a result thereof, using the vapor pressure relationship, the low-pressure column can be operated at a pressure of 4.8 bars.

In FIG. 1 430,000 $Nm^3/h$ of cooled and compressed air enter the high pressure column 1 at 4. 52,500 $Nm^3/h$ of crude oxygen (40% oxygen content) are introduced under throttling into the low pressure column 2 via conduit 5. 205,000 $Nm^3/h$ of a nitrogen fraction are withdrawn from the high pressure column 1 and are conducted to the top of the low pressure column by conduit 6. 100,000 $Nm^3/h$ of product oxygen of a purity of 98% are withdrawn from the low pressure column via conduit 7. 400,000 $Nm^3/h$ of a nitrogen fraction are discharged by conduit 8. In accordance with the invention 330,000 $Nm^3/h$ of gas are withdrawn from the high pressure column 1 at 9 and are subjected to a fractional condensation in reflux, condenser 10. The nitrogen rich fraction obtained during the fractional condensation (157,500 $Nm^3/h$) is introduced to the high pressure column at 11. 172,500 $Nm^3/h$ liquid crude oxygen (40% oxygen content) collected in the lower portion of the reflux condenser 10 are expanded in valve 12 to 2.8 bar. This stream serves as the driving stream for the ejector 3, which is a conventional jet compressor. The driving stream may reach a maximum speed of about 200 m/sec in the ejector 3. The ejector 3 takes 125,500 $Nm^3/h$ of gas via conduit 14 and reintroduces such gas via conduit 15 above the partition 13.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for the separation of a low-boiling gaseous mixture by low-temperature rectification, comprising the steps of:

(a) subjecting said gaseous mixture to rectification in a high pressure zone to obtain a crude light fraction and a crude heavy fraction;

(b) passing said crude light fraction and at least a part of said crude heavy fraction to an intermediate pressure rectification zone having plates to obtain an enriched gaseous overhead and an enriched liquid bottoms, said at least a part of said crude heavy fraction being passed to said intermediate pressure rectification zone via an ejector wherein said at least a part of said crude heavy fraction acts as driving means therefor;

(c) passing said enriched liquid bottoms into a low-pressure rectification zone having plates; and (d) withdrawing vapor from said low pressure rectification zone by suction through said ejector, increasing the pressure of said vapor in said ejector and passing resultant vapor into the intermediate pressure rectification zone, whereby the pressure in the high pressure column is lower than the pressure in a high pressure column of a double column employing only one pressure zone in the low pressure column.

2. A process according to claim 1, wherein said crude heavy fraction prior to being passed to the ejector, is subjected to fractional condensation in a reflux condenser and, after a throttle expansion, is vaporized countercurrently to a crude fraction of the light component.

3. Process according to claim 1, wherein said crude heavy fraction prior to being passed to the ejector is withdrawn in the liquid phase from the lower portion of the high-pressure stage and subjected to a throttle expansion in a condenser located in the head of the high-pressure stage.

4. A process according to claim 1, wherein said low-boiling gaseous mixture is air.

5. A process according to claim 4, wherein said high pressure zone is under a pressure of 4.5–4.9 bars, the intermediate pressure rectification zone is under a pressure of 1.25–1.6 bars, and the low pressure zone is under a pressure of 1.01–1.3 bars.

6. A process according to claim 4, wherein said high pressure zone is under a pressure of about 4.6 bars, the intermediate pressure rectification zone is under a pressure of about 1.35 bars, and the low pressure zone is under a pressure of about 1.1 bars.

7. A process according to claim 1, wherein the bottom of the low pressure heat exchange zone is in direct heat exchange contact with the top of the high pressure rectification zone.

8. A process according to claim 5, wherein the bottom of the low pressure heat exchange zone is in direct heat exchange contact with the top of the high pressure rectification zone.

9. A process according to claim 1, further comprising withdrawing enriched heavy fraction from said low pressure rectification zone.

10. A process according to claim 5, further comprising withdrawing enriched oxygen as product from said low pressure rectification zone.

11. A process according to claim 8, further comprising withdrawing enriched oxygen as product from said low pressure rectification zone.

* * * * *